United States Patent [19]

Suchko

[11] 4,231,073

[45] Oct. 28, 1980

[54] AUTOMATIC IMPROVED ENGINE CONTROL SYSTEM CONTAINING BOTH SOLID STATE CIRCUITS AND RELAYS

[76] Inventor: Adam J. Suchko, 636 N. Oakland Ave., Indianapolis, Ind. 46201

[21] Appl. No.: 958,825

[22] Filed: Nov. 8, 1978

[51] Int. Cl.[3] ..... H02H 3/04

[52] U.S. Cl. ..... 361/1; 123/179 B; 290/37 R; 307/10 R; 361/24

[58] Field of Search ..... 361/51, 1, 52, 241, 361/20, 21; 290/37, 38, 36, 40 R; 123/179 R, 179 A, 179 B, 179 G, 179 BG; 307/10, 132 R, 132 E, 132 M

[56] References Cited

U.S. PATENT DOCUMENTS

| | | | |
|---|---|---|---|
| 3,325,657 | 6/1967 | Corey | 290/38 R X |
| 3,415,999 | 12/1968 | Noury | 123/179 B X |
| 3,514,621 | 5/1970 | Farmer et al. | 290/37 R |
| 3,569,724 | 3/1971 | Kuehn | 290/37 R |

OTHER PUBLICATIONS

A Schematic Diagram designed by Suchko, Oct. 22, 1976–"Automatic Starting Panel with Fault Monitor and Shutdown".

*Primary Examiner*—Patrick R. Salce
*Attorney, Agent, or Firm*—Woodard, Weikart, Emhardt & Naughton

[57] ABSTRACT

An automatic engine control system in which all solid state circuitry is isolated by open switches, open relay contacts and reversed biased diodes from either ground or the power supply during the standby state of the system. All solid state circuitry except that contained in the alarm circuitry is isolated during an alarm condition after shutdown of the engine has been effected. Novel circuitry is used for allowing the latching of a fault response relay while at the same time removing ground from other solid state circuitry. Further, the automatic engine starter and controller of the present invention utilizes unique and novel means for controlling the battery charger of the controlled engine and for initiating and resetting solid state timing circuitry.

21 Claims, 5 Drawing Figures

ENGINE CONTROL RELAYS

AUTOMATIC IMPROVED ENGINE CONTROL SYSTEM CONTAINING BOTH SOLID STATE CIRCUITS AND RELAYS

BACKGROUND OF THE INVENTION

1. The Field of the Invention

The field of the invention is automatic engine control systems; more particularly, such systems which automatically activate the start means and the shutdown of an internal combustion engine, monitor the engine for fault conditions which may cause damage to the engine, and when such fault conditions occur, automatically activate the shutdown of the engine and indicate the existing fault.

2. Description of the Prior Art

There are numerous engine control systems in the prior art. Most control units automatically control the start of the engine and automatically cause the engine to shutdown if ignition does not occur within a specified time. The systems have engine sensors that are sensitive to various fault conditions which may damage the engine; and will cause the engine to shutdown in the event that a fault condition is detected.

Earlier control units were electrically operated by mechanical switches and relays. These systems presented problems of reliability after extended periods of use. They were susceptible to malfunction due to the effects of the vibration of the engine and other external factors. Their timing circuitry was not reliable and the circuits were not sensitive to small variations in the operating signals. The units were often quite expensive More recent systems have taken advantage of solid state circuitry. These systems are more compact, have reliable timing circuitry, and are less susceptible to external factors. However, for these systems to operate properly they must generally be in an energized state during the entire time that they are in operation because a trickle current is required in order to maintain the various solid state components in a standby state.

As a result of the necessity that the solid state components be constantly maintained in an energized state, these systems are susceptible to false triggers due to voltage transients. The extended exposure of the solid state components to surges and interruptions in power causes a higher incidence of component failure. Solid state components are significantly more susceptible to certain types of abuse than are relays. In addition, because a trickle current must be constantly maintained, the lifetime of the system itself is diminished.

Solid state systems generally utilize transistors or SCR's to latch various signals and to control the start up and the shutdown of the engine. There are several disadvantages with maintaining such signals through solid state components. Momentary surges and interruptions in power can initiate false triggers and release latched conditions. When solid state components are used for this purpose they must be constantly maintained in an energized state, thus their expected useful lives are diminished.

Solid state systems in the prior art are also often susceptible to damage caused by miswiring of the system to the battery and the various engine controls. This is because the requirement that these components be constantly maintained in an energized state causes them to be exposed to damage in the event of miswiring.

Automatic engine control systems have generally not integrated a means for controlling the operation of the battery charger of the controlled engine. Certain systems which have done so that only energized the charger during the normal operation of the engine.

BRIEF DESCRIPTION OF THE INVENTION

The present invention is an improved automatic engine control system that is uniquely and ingeniously designed to take advantage of the most desirable aspects of both electro-mechanical circuit devices and solid state circuitry. The general nature of the invention is set forth in the claims and reference should be made thereto for an understanding of the scope of the invention.

The preferred embodiment has solid state circuitry which includes a cranking module having an oscillator circuit which cycles on and off thus activating and deactivating the cranking of the engine, an overcrank module having time delay circuitry which detects when an overcrank condition has occurred; reset circuitry which resets the cranking module and overcrank module when the engine has been started; time delay circuitry which delays fault condition engine shutdown where low oil pressure is indicated; and start up circuitry which prevents a false alarm condition at the initiation of the system. This solid state circuitry has the advantage of reliable, adjustable timing at low cost.

There are numerous advantages in the preferred embodiment of the present invention which become apparent after a review of the Detailed Description of the Preferred Embodiment and an examination of the circuitry disclosed in the diagrams.

Generally, it can easily be seen that the preferred embodiment is designed so that the solid state components are exposed to current a minimal amount of time thus extending the useful life of the components and the system. Further, during the periods when current is not applied across the solid state components, the circuits are maintained open by open switches, open contacts and reverse biased diodes. In particular, the non-fault condition solid state current passes through a set of relay contacts of an alarm relay and an on/off mechanism to ground. The on/off mechanism may be either a manually controlled switch or an automatic remote control device such as a thermostat or other device sensitive to a condition which requires the start up of the engine. Thus when the system is turned on, no current passes through the non-fault condition circuitry except during the periods of time in which the engine is actually running or being started. When an alarm condition results, the solid state circuitry is removed from ground by the opening of normally open alarm relay contacts. However, the alarm condition signal itself is latched by the closure of a second set of alarm relay contacts that are normally open.

Because of its unique design, the preferred embodiment is not susceptible to false triggers and unintended release of latched conditions as a result of momentary surges and interruptions in power. Because it is not necessary to maintain a trickle current, the lifetime of the individual components and of the system is extended.

The system also utilizes an ingenious method of controlling the battery charger of the engine, which causes the battery to charge except during the running of the starter.

BRIEF DESCRIPTION OF THE DRAWINGS

FIG. 2B should be placed to the left of FIGS. 2A and 2C.

DETAILED DESCRIPTION OF THE PREFERRED EMBODIMENT

Figure 1:
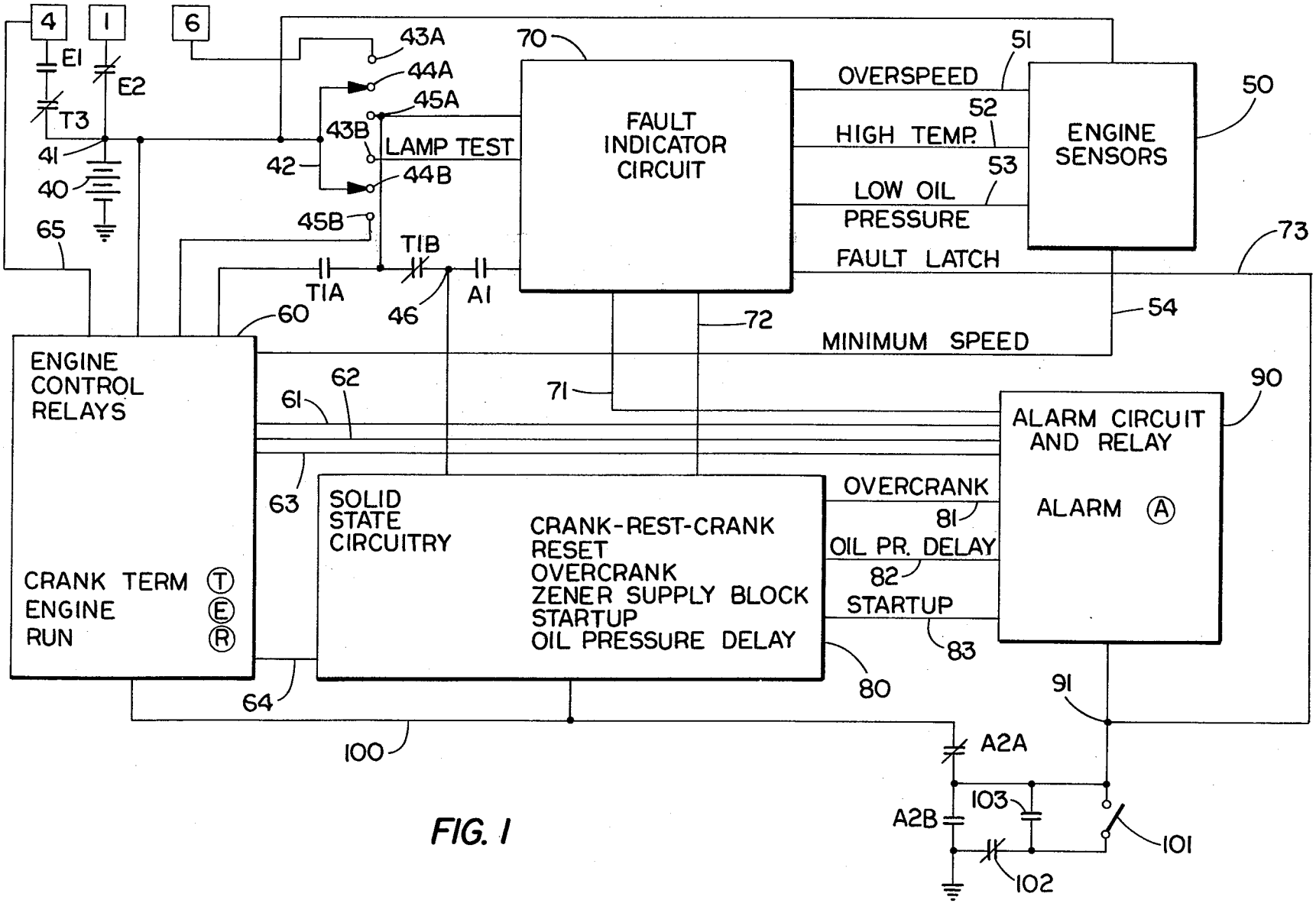
FIG. 1 is a block diagram of the preferred embodiment of the present invention illustrating the interrelationship of the various circuits.

Referring in particular to FIG. 1, there is illustrated the preferred embodiment of the automatic starter and engine control system. The system includes a direct current battery 40 which may be chosen with which a voltage of 24 or 36 volts. The negative terminal of battery 40 connects to ground. The positive terminal 41 of battery 40 is connected to an electrical switch 42 having three positions 43A and B; 44A and B; and 45A and B. The positive terminal 41 also has a lead to the Engine Sensors 50 and the Engine Control Relays Circuit 60 (which contains shutdown timer circuitry of FIG. 2B). The positive terminal 41 is also connected to terminals 1 and 4 through normally closed relay contacts E2; and through normally open relay contacts E1 and normally closed relay contacts T3 respectively.

Position 43A of the electrical switch 42 is connected directly to terminal 6. Position 43B is connected to the Fault Indicator Circuit 70. Positions 44A and 44B are open electrical points. Position 45A connects directly to the Fault Indicator Circuit 70 and is also connected indirectly to the Engine Control Relays Circuit 60 through normally open relay contact T1A. Position 45A is also connected to Fault Indicator Circuit 70 through relay contacts normally closed T1B and normally open A1. Position 45B connects to the Engine Control Relays Circuit 60. The electrical point 46 between the relay contacts T1B and A1 is connected to the Solid State Circuitry 80.

Lines 51, 52 and 53 provide connections between the Engine Sensors 50 and the Fault Indicator Circuit 70. Line 54 is a connection between the Engine Sensors 50 and the Engine Control Relays Circuit 60. The Engine Control Relays Circuit is connected to the Alarm Circuit 90 through lines 61, 62 and 63. Line 64 connects the Engine Control Relays Circuit 60 with the Solid State Circuitry 80. The Engine Control Relays Circuit 60 is also connected to terminal 4 through line 65. The Engine Control Relays Circuit is connected to common bus line 100.

The Fault Indicator Circuit 70 is connected to the Alarm Circuit through line 71 and to the Solid State Circuitry 80 through line 72. The Fault Indicator Circuit 70 and the Alarm Circuit 90 are connected to a common electrical point 91 through line 73.

Lines 81, 82 and 83 connect the Solid State Circuitry 80 to the Alarm Circuit 90. The Solid State Circuitry 80 is connected to the common bus line 100.

The common bus line 100 is connected to point 91 through normally closed relay contacts A2A. Point 91 connects through normally open relay contacts A2B to ground. Said relay contacts A2A and A2B are in a single pole double throw configuration with their common electrical point being the common electrical point 91. Electrical point 91 is also connected to ground through switch 101 and normally closed contacts 102 in series. Electrical point 91 is also connected to ground through normally open contacts 103 and contacts 102 in series.

Figure 2A:
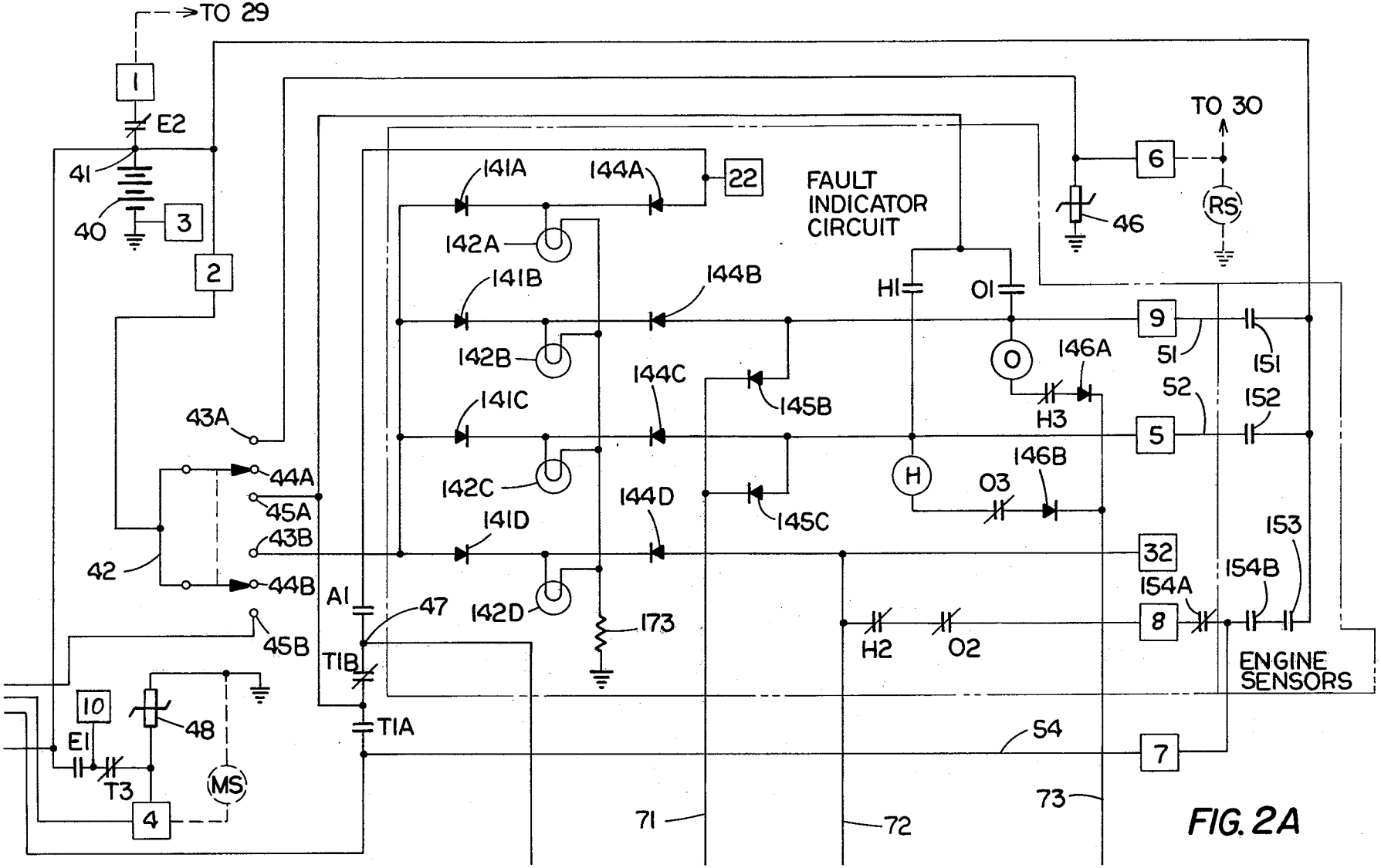
FIGS. 2A, 2B and 2C represent a schematic diagram of the preferred embodiment of FIG. 1. When these diagrams are placed in juxtaposition they illustrate a complete schematic. In matching the diagrams FIGS. 2C should be placed below FIG. 2A.
Figure 2B:
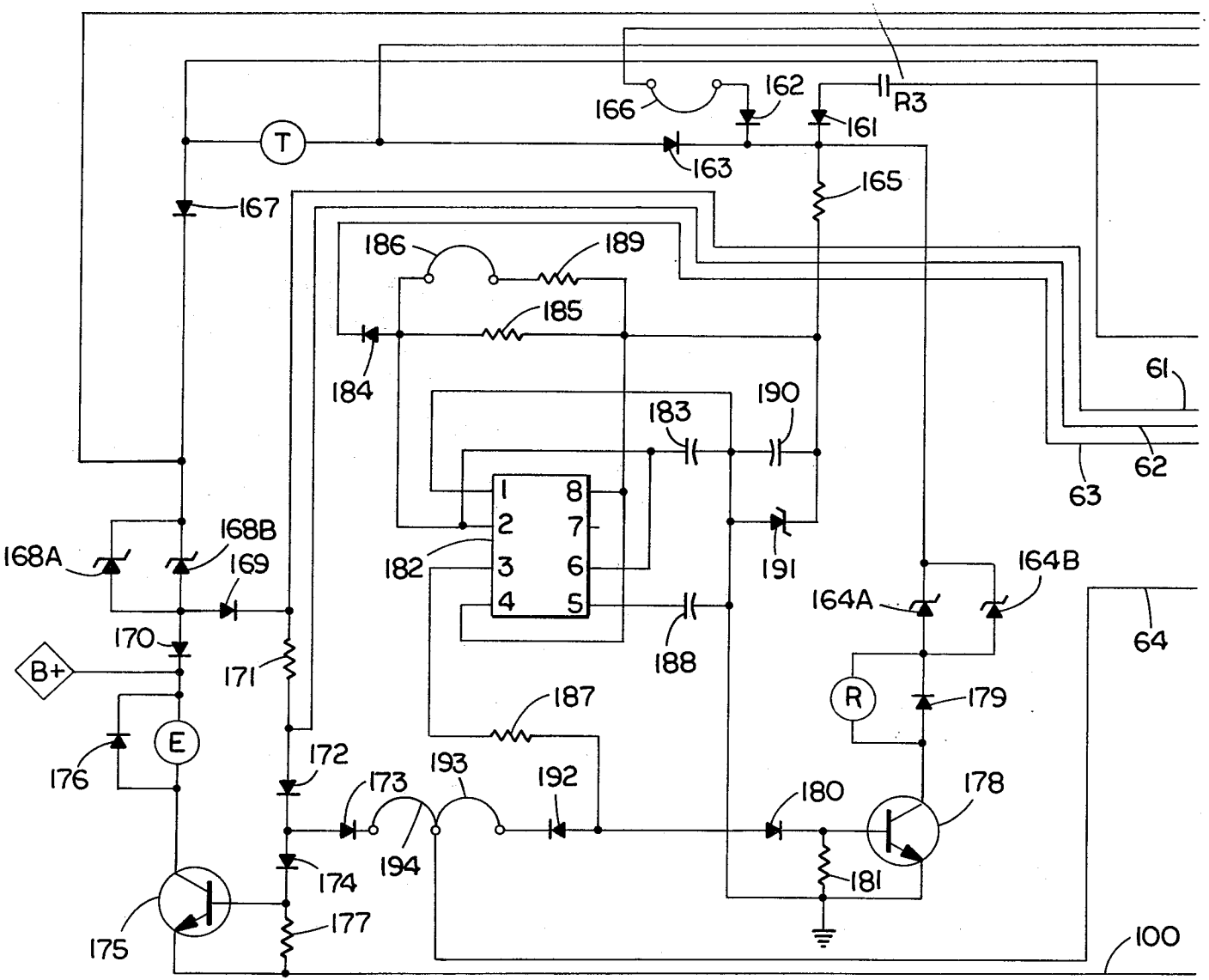
Figure 2C:
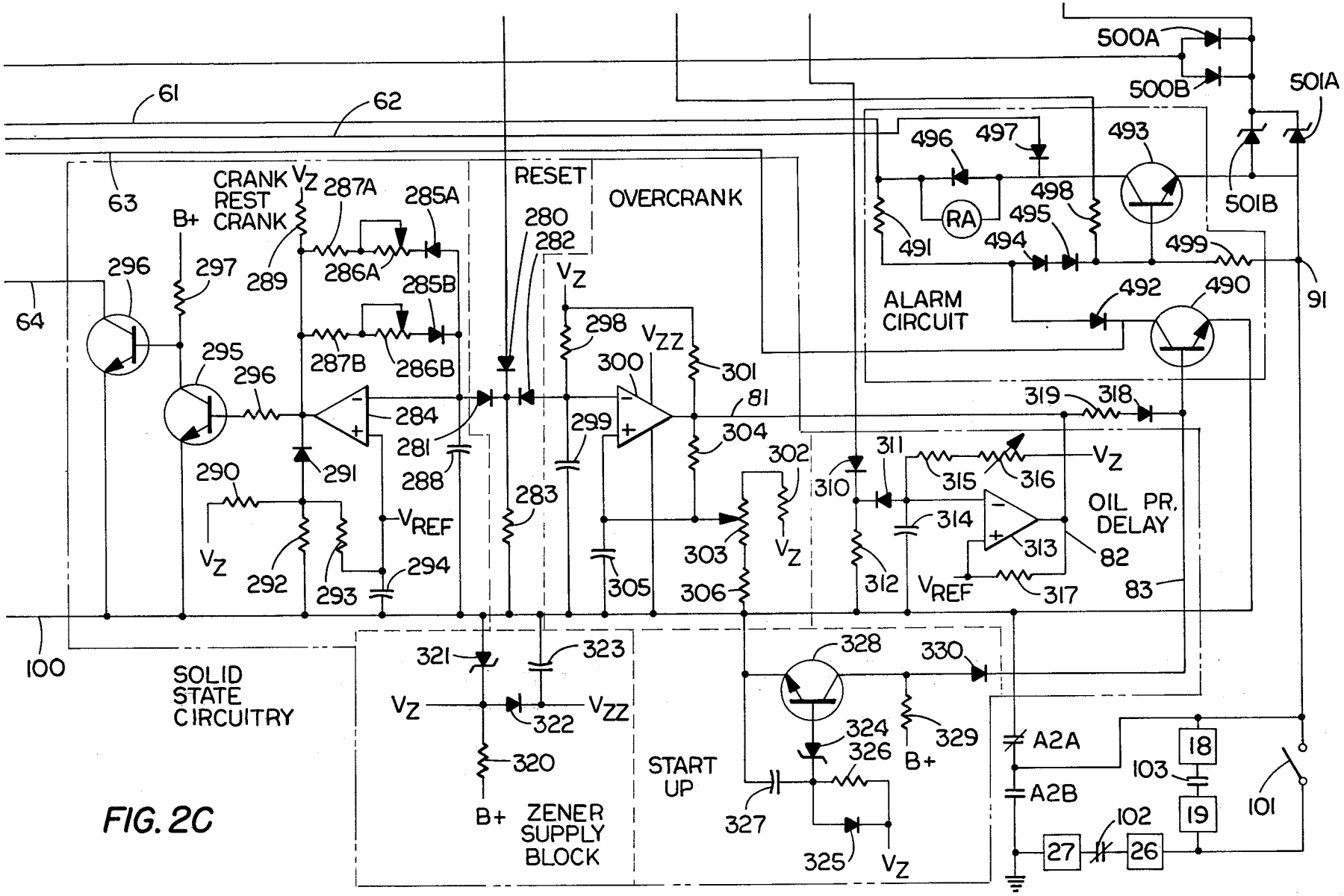
Figure 2D:
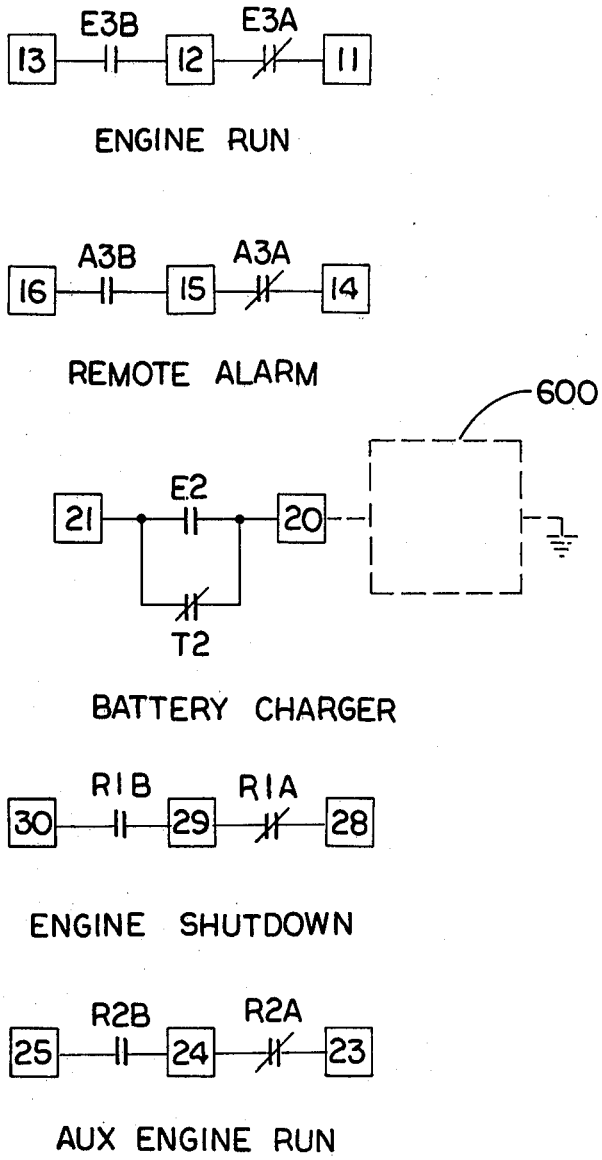
FIG. 2D illustrates various additional output contacts that are used in the preferred embodiment of FIG. 1.

FIGS. 2A, 2B and 2C represent a schematic diagram of the preferred embodiment. When placed in juxtaposition, these figures illustrate a complete schematic of the preferred embodiment. In matching the diagrams, FIG. 2C should be placed below FIG. 2A and FIG. 2B should be placed to the left of FIG. 2A and 2C. There are additional output contacts in the preferred embodiments. These output contacts are illustrated in FIG. 2D and will be more fully discussed later.

The negative terminal of the battery 40 connects directly to terminal 3 and to ground. The positive terminal 41 of the battery 40 of the preferred embodiment is connected to terminal 1 through normally closed relay contacts E2. Terminal 1 is suitable for use for a de-energize-to-run component of an engine. The positive terminal 41 is also connected to terminal 10 through normally closed contacts T3. Terminal 10 connects to terminal 4 through normally open contacts E1. Terminal 10 is suitable for use for an energize-to-run component of an engine. Terminal 4 is connected to ground through metal oxide varistor 48. Normally a magnetic switch used in energizing a starter solenoid is connected between terminal 4 and ground. Normally open relay contacts R3 and Engine Sensors 151, 152 and 153 are also connected to the positive terminal 41.

Positive terminal 41 is also connected to an electrical switch 42 having three positions 43A and B; 44A and B and 45A and B. Position 43A connects to terminal 6 and is connected to ground through metal oxide varistor 47. Normally a rack solenoid is connected between terminal 6 and ground. Position 43B is connected to the anodes of diodes 141A, 141B, 141C and 141D. The cathodes of diodes 141A-D are connected to one end of resistor 173 and lamps 142A-D, respectively. The other end of resistor 173 connects to ground. The cathodes of diodes 141A-D are also connected to the cathodes of diodes 144A-D, respectively. The anode of diode 144A is connected to terminal 22 and relay contacts A1. The anodes of diode 144B is connected to the anode of diode 145B, normally open relay contacts O1, relay O and terminal 9. Terminal 9 is also connected to Engine Sensor 151. The anode of diode 144C is connected to the anode of diode 145C and is also connected to the normally open relay contacts H1, relay H and terminal 5. Terminal 5 is connected to Engine Sensor 152. The anode of diode 144D is connected to terminal 32 and is also connected to terminal 8 through normally closed relay contacts normally closed H2 and O2. Terminal 8 is connected to engine Sensor 153 through single pole double throw contacts 154A and 154B.

Relay O is connected to the anode of diode 146A through normally closed relay contacts H3. Relay H is connected to the anode of diode 146B through normally closed relay contacts O3.

Position 45A is connected to normally open relay contacts H1, O1 and T1A and normally closed relay contacts T1B. Position 45B is connected to the cathodes of diodes 167, 168A and 168B. Relay contacts R3 are connected to the anode of diode 161. The cathode of diode 161 is connected to the cathodes of diodes 162, 163 and the cathodes of zener diodes 164A and 164B and is also connected to resistor 165. The anode of diode 162 is connected to terminal 4 through jumper 166. The anode of diode 163 is connected to relay T and terminal 7. Terminal 7 in turn is connected to the common electrical point of the single pole double throw contacts 154A and B, and terminal 7 is connected to position 45B through relay contacts T1A. Relay contacts T1A in turn is connected to relay A1 through relay contacts T1B. Relay T is also connected to the anodes of diodes 500A and 500B (FIG. 2C) and, is connected to the anode of diode 167. The anodes of diodes 168A and B are connected to the anodes of diodes 169 and 170. The cathode of diode 169 is connected to line 61 and is also connected to line 62 through resistor 171. The anode of the diode 172 is connected to line 62. The cathode of diode 172 is connected to the anodes of diodes 173 and 174. The cathode of diode 170 is the voltage supply point B+ and is connected to the collector of transistor 175 through relay E and is also connected to the cathode of diode 176. The anode of diode 176 is connected to the collector of transistor 175. The cathode of diode 174 is connected to the base of transistor 175 and is connected to the emitter of transistor 175 through resistor 177. The emitter of transistor 175 is connected to common bus line 100. The anodes of zener diodes 164A and B are connected to the collector of transistor 178 through relay R and are also connected to the cathode of diode 179. The anode of diode 179 is connected to the collector of transistor 178. The base of transistor 178 is connected to the cathode of diode 180 and is connected to ground through resistor 181. The emitter of transistor 178 is connected to ground. Lead 1 (chip ground) of timer 182 is connected to ground. This timer is preferably a Signetics NE-555-V timer. Lead 2 (trigger) of timer 182 is connected to ground through capacitor 183 and is connected to the anode of diode 184, lead 6 (threshold), resistor 185 and jumper 186. Lead 3 (output) of timer 182 is connected to the anode of diode 180 through resistor 187. Lead 4 (reset) of timer 182 is connected to lead 8 (chip supply) and is connected to lead 2 through resistor 185. Lead 5 (control voltage) of timer 182 is connected to ground through capacitor 188. Jumper 186 is connected to lead 8 of timer 182 through resistor 189. Lead 8 of timer 182 is connected to the cathode of diode 161 through resistor 165. Resistor 165 connects to ground through capacitor 190 and through zener diode 191. The anode of zener diode 191 is connected to ground.

The cathode of diode 173 connects to line 64 through jumper 194. The cathode of diode 192 connects to line 64 through jumper 193. The anode of diode 192 is connected to the anode of diode 180.

The anode of diode 280 connects to the electrical point 46. The cathode of this diode is connected to the cathodes of diodes 281, 282 and is connected to the common bus line 100 through resistor 283.

The anode of diode 281 is connected to the anode of diode 285A, and the cathode of diode 285B. The output of comparator 284 is connected to the cathode of diode 285A and the anode of 285B through the variable resistor 286A and resistor 287A and through the variable resistor 286B and resistor 287B, respectively. The anode of diode 281 in addition is connected directly to the inverting input of comparator 284 (CA-339 made by RCA) and is connected to the common bus line 100 through the capacitor 288. Voltage supply point $V_Z$ connects to the output of the comparator 284 through resistor 289. The voltage supply point $V_Z$ also connects to the output of the comparator 284 through resistor 290 and diode 291, the cathode of said diode being connected directly to the output of comparator 284. The anode of diode 291 connects to the common bus line 100 through resistor 292 and in series through resistor 293 and capacitor 294. The non-inverting input of comparator 284 connects to the common bus line 100 through capacitor 294. A voltage supply point $V_{REF}$ is located at the non-inverting input of comparator 284 and connects to other portions of the circuit so designated. The base of transistor 295 connects to the output of the comparator 284 through resistor 296A. The emitter of transistor 295 is connected to the common bus line 100. The collector of this transistor is connected to the base of transistor 296 and is connected to the voltage supply point B+ through resistor 297. The emitter of transistor 296 is connected to common bus line 100. The collector of transistor 296 connects to line 64.

The anode of diode 282 connects to the voltage supply point $V_Z$ through resistor 298 and connects to the common bus line 100 through capacitor 299. The anode of diode 282 is connected directly to the inverting input of the comparator 300. The voltage supply point $V_Z$ connects to the output of the comparator 300 through resistor 301 and through resistor 302, variable resistor 303 and resistor 304 in series.

The non-inverting input of the comparator 300 connects to the common bus line 100 through capacitor 305 and also connects to the wiper contact of variable resistor 303. The voltage supply point $V_Z$ connects to the common bus line 100 through resistor 302, potentiometer 303 and resistor 306 in series.

Line 72 connects terminal 32 to the anode of diode 310. The cathode of diode 310 is connected to the cathode of diode 311 and is connected to the common bus line 100 through resistor 312. The anode of diode 311 is connected directly to the inverting input of the comparator 313 and is connected to ground through capacitor 314 and is connected to the voltage supply point $V_Z$ through series resistor 315 and variable resistor 316. The voltage supply point $V_{REF}$ is connected directly to the non-inverting input of the comparator 313 and is connected to the output of comparator 313 through resistor 317. The voltage supply point $V_{REF}$ is also connected to the non-inverting input of comparator 284.

The outputs of comparators 300 and 313 are connected directly to each other and are connected to the anode of diode 318 through resistor 319.

Voltage supply point B+ connects to the common bus line 100 through resistor 320, voltage supply point $V_Z$ and the reverse biased zener diode 321. Voltage supply point $V_Z$ is connected to the anode of diode 322. The cathode of diode 322 connects to the common bus line 100 through capacitor 323 and directly to the voltage supply point $V_{ZZ}$.

Voltage supply point $V_Z$ is connected to the cathode a zener diode 324 through the parallel combination of a diode 325 and resistor 326. The anode of diode 325 and the cathode of zener diode 324 are connected to each other. The cathode of the zener diode 324 in turn is connected to the common bus line 100 through capacitor 327. The anode of the zener diode 324 is connected to the base of the transistor 328. The emitter of transistor 328 is connected to the common bus line 100. The collector of transistor 328 is connected to the voltage supply point B+ through resistor 329 and is connected to the anode of diode 330. The cathode of diode 330 is connected to the cathode of diode 318.

The cathodes of diodes 318 and 330 are connected to the base of transistor 490. The emitter of transistor 490 is connected directly to the common bus line 100. The collector of transistor 490 is connected to line 63. Line 61 connects to the collector of transistor 490 through resistor 491 and the diode 492 the cathode of diode 492 being connected directly to transistor 490. Line 61 is connected to the anode of diode 494 through resistor 491. The cathode of diode 494 is connected to the anode of diode 495 and the cathode of diode 495 is connected to the base of transistor 493. Line 61 is also connected to the collector of transistor 493 through the relay A. Line 61 is connected to the collector of transistor 493 through the diode 496, the anode of said diode being in contact with said collector. Line 62 is connected to the collector of transistor 493 through the diode 497, the cathode of said diode being in contact with said collector. Line 71 is connected to the base of transistor 493 through resistor 498. The base of transistor 493 is connected to the common electrical point 91 through resistor 499.

The anodes of diodes 500A and B are connected to the anode of diode 167 and the cathode of diodes 500A and B are connected to the cathodes of zener diodes 501A and B and to line 73. The anodes of the zener diodes 501A and B and the emitter of transistor 493 are connected to the common electrical point 91.

The common bus line 100 connects to the common electrical point 91 through the relay contacts A2A. The common electrical point is connected to ground through relay contacts A2B. The common electrical point 91 is also connected to ground through the series combination of switch 101 and contacts 102; and the common electrical point 91 is connected to ground through the series combination of contact 103 and contact 102.

FIG. 2D illustrates the various additional output contacts that are used in the preferred embodiment. Terminals 11 and 12 are connected to each other through normally closed relay contacts E3A. Terminals 12 and 13 are connected to each other by normally open relay contacts E3B. Terminal 15 is connected to terminal 14 by normally closed relay contacts A3A and is connected to terminal 16 by normally open relay contacts A3B. Terminal 20 is connected to terminal 21 by normally open relay contacts T2 and by normally closed relay contacts E2. Typically a battery charger 600 is connected with its "plus" supply connected to terminal 20; and terminal 21 connected to terminal 2. Terminal 24 is connected to terminal 23 by normally closed relay contacts R2A and is connected to terminal 25 by normally open relay contacts R2B. Terminal 29 is connected to terminal 28 by normally closed relay contacts R1A and is connected to terminal 30 by normally open relay contacts R1B.

In the operation of the preferred embodiment, position 43 of the three-way switch 42 is utilized for the dual purpose of a lamp test and emergency shutdown. Position 43A is connected directly to terminal 6 which in turn can be connected to a rack solenoid or other appropriate means for shutting down the operation of the engine. The lamp test power is supplied through position 43B to diodes 141A through D, lamps 142A through D and resistor 173 to ground. This circuit reveals the existence of any defective lamps. Diodes 144A through D act as blocking diodes to isolate the lamp test from the remainder of the circuit. Position 44 of switch 42 is the off/reset position. Position 45 is the "on" position. When switch 42 is in the "cn" position the system is ready for operation. However, there are no closed circuits and thus no current is flowing through the system unless either the manual switch 101 or the remote start switch 103 is closed to ground.

Engine Sensors 50 detect various conditions in the controlled engine and indicate these conditions to the Fault Indicator Circuit 70 and to the Engine Control Relay Circuit 60. Sensor 151 is an overspeed sensor and will produce a signal through line 51 when the engine exceeds a preset rpm. Sensor 152 is heat sensitive and will produce a signal if the water temperature in the engine is excessive. A signal produced by Engine Sensor 152 leads to the Fault Indicator Circuit 70 through line 52. Sensor 153 will close when the engine has reached a minimum rpm that is higher than the maximum cranking speed. When this sensor is closed in combination with the closing of sensor 154B, which indicates that a minimally allowed oil pressure has been reached, then a signal that the engine has started is passed to the Engine Control Relays Circuit 60 through line 54. This signal energizes the crank terminate relay T which in turn switches the single pole double throw contacts T1A and T1B. The closure of T1A latches the crank termination indication. The opening of relay contacts T1B removes the voltage applied to point 46 prohibiting a false indication of an overcrank condition by a current through relay contacts A1 to the overcrank condition lamp 142A. During crank the voltage applied to point 46 through relay contacts T1B initiates the oscillation of the cranking module means for activating and deactivating the start means and also initiates the overcrank module means for indicating an overcrank condition and deactivating the start means when the engine does not start within a specified time. When voltage is removed from point 46 by the opening of relay contacts T1B these circuits are deactivated and reset.

Turning now more specifically to the cranking module and the overcrank module, when voltage is applied to the reset circuit through point 46 the voltage at the inverting input point of the comparator 284 increases and thus the cranking module oscillation is initiated. This circuit produces a periodic voltage output through resistor 296 to the base of transistor 295. The period of oscillation can be controlled by adjusting the variable resistors 286A and 286B. When voltage is applied across resistor 296, transistor 295 is turned on and draws current from the voltage supply point B+ through resistor 297. This in turn shuts off transistor 296. When transistor 296 is off, voltage is applied to the base of transistor 175 activating transistor 175 and energizing the engine relay E. As transistor 295 shuts off, as a result of the oscillation of the cranking module, transistor 296 is activated and this in turn deactivates transistor 175 which de-energizes the engine relay E. The activation and deactivation of the engine relay E periodically closes and opens relay contacts E1 to terminal 4 which in turn is connected to a magnetic switch or some other appropriate means for activating the cranking of the engine.

The application of voltage to point 46 initiates the overcrank module timing circuit in a similar fashion. If voltage is not removed within a specified period of time from point 46 by the opening of relay contacts T1B which indicates that the engine has started, then the overcrank module circuit will produce a signal through line 81 to the Alarm Circuit 90. This signal is indicated by the removal of voltage from the base of transistor 490. The removal of this voltage turns off said transistor which in turn activates transistor 493. The activation of transistor 493 closes a circuit through the alarm relay A. The energizing of alarm relay A closes the relay contacts A2B which latches the alarm condition. The energizing of alarm relay A also opens the normally closed relay contacts A2A which are the sole means for conducting current from the common bus line 100 to ground. Thus the Solid State Circuitry 80 is removed from ground and no current passes through it. Note that the opening of this circuit also de-energizes the engine relay E and thus terminates the cranking of the engine.

When an alarm condition is indicated as a result of an overcrank condition, a circuit is closed through the normally closed contacts T1B and the closure of the contacts A1 to the Fault Indicator Circuit. In this manner, an overcrank condition is indicated by the overcrank lamp 142A.

The zener supply block comprising elements 320 to 323 is a circuit used to supply the various voltages required for the timing and oscillation circuits of the Solid State Circuitry 80. The startup circuit comprising components 324 to 330 supplies an initial voltage to the base of transistor 490 when cranking is initiated. This avoids the possibility of a false overcrank alarm condition indication.

During the normal operation of the engine, when an overspeed signal is sent through line 51 to the Fault Indicator Circuit, overspeed lamp 142B is lit indicating that an overspeed condition has occurred; relay O is energized thus closing normally open contacts 01 and latching the fault signal. Normally closed relay contacts 02 and 03 are opened by the energizing of relay O thus preventing the indication of an after-occurring fault. The fault signal passes through diode 145B, line 71 and resistor 498 to the base of transistor 493, thus activating transistor 493. The activation of transistor 493 closes a circuit through the alarm relay A energizing the alarm relay A. The energizing of alarm relay A opens the normally closed relay contacts A2A thus removing the Solid State Circuitry from ground; and also closes the alarm relay contacts A2B thus latching the alarm signal. This sequence occurs each time any of the four alarm conditions is indicated. Note that the Solid State Circuitry is completely removed from ground, even though the manual switch 101 or the remote contacts 103 are closed, and thus no current flows through the system except that current which is indicating the alarm condition and activating the shutdown means.

The shutdown circuitry must maintain a circuit for a period after an alarm condition has been initiated in order to effectuate the shutdown of the engine. To achieve this end in this circuit, the shutdown circuitry is directly attached to ground and has power supplied to it through the latching relay contacts R3. When the shutdown is completed, relay contacts R3 open, thus isolating this part of the system from the power source. Note that all potential current paths resulting from voltage transients, between the positive terminal of the battery 41 and ground are through reverse biased diodes. To minimize any potential damage to the system, these diodes have a breakdown voltage rating in excess of 800 volts.

A high water temperature signal through line 52 acts in a similar manner as the overspeed signal through line 51. High water temperature lamp 142C indicates that a high water temperature fault condition exists, relay H is energized thus closing normally open relay contacts H1 latching the fault condition signal. Normally closed relay contacts H2 and H3 are opened by the energizing of relay H thus preventing the indication of an after-occurring fault condition. A fault condition signal is sent through diode 145C, line 71 and resistor 498 to the base of transistor 493 energizing the alarm relay A.

The activation of the circuitry controlling the shutdown of the engine is enabled when an alarm condition exists by line 63 which changes from a relatively low voltage to a relatively high voltage when transistor 490 is turned off. This in turn allows the voltage at lead 2 of the timer 182 to change from a relatively low voltage to a relatively high voltage. The time which is taken for the voltage to increase sufficiently high to trigger the timer depends upon the relative capacitance of capacitor 183 and resistance of resistor 185. If the jumper 186 is connected, then the time delay before initiating the timer 182 will be diminished.

The shutdown circuitry will not be enabled unless there is voltage applied to it. This voltage can be supplied through diode 163 during the normal run operation of the engine. If desired jumper 166 can be attached and voltage would then be applied to the shutdown circuitry during the crank cycle of the engine.

Lead 3 is the output of the timer 182. The duration of the output after initiating shutdown can be set for any reasonable time. In the preferred embodiment the output signal lasts for as long as the engine runs plus approximately 30 seconds. This output signal increases the voltage at the base of transistor 178 and thereby activates it. This closes a current path which passes through run relay R. The energizing of run relay R closes the normally open relay contacts R3 whereby this circuit is latched for the duration of the output signal from the timing device 182. When the output signal ceases, transistor 178 is deactivated and thus run relay R is de-energized opening contacts R3. When relay contacts R3 are opened in this manner, the circuit is returned to an open state and no current passes through it.

Reference is made to FIG. 2D in which is shown terminals 28, 29 and 30 connected by relay contacts R1A and R1B. When terminal 30 is appropriately connected to a rack solenoid RS or other shutdown means, and terminal 29 connected to terminal 1, then the shutdown of the engine will be accomplished. When jumper 193 is connected, the run relay R is deactivated during the rest portions of the cranking cycle. However, shutdown of the engine does not occur because relay contacts E2 are open during this period. This innovation allows external functions to be controlled by run relay contacts for a combination of various periods of time. When jumper 194 is removed, the crank of the engine continues until the overcrank timer operates. Note that during the standby mode of operation all Solid State Circuitry is isolated from external connections by open switches, open relay contacts and reverse biased diodes.

FIG. 2D illustrates various additional output contacts that are used in the preferred embodiment. By making connections to terminals 11 and 12, an external device can be controlled to operate at all times except during the cranking and normal running of the engine. By making connections to terminals 12 and 13, an external device can be controlled to operate only during the cranking and normal running of the engine.

In the same manner, by making the appropriate connections to terminals 14, 15, and 16, an external device will operate either solely when there is an alarm condition or solely when there is no existing alarm condition. Also, the same type of connection on terminals 23, 24, and 25 provide an auxillary isolated contact set. Terminals 28, 29, and 30 can control the operation of either an energizing or a de-energizing means for shutdown of the engine.

While there have been described above the principles of this invention in connection with specific apparatus, it is to be clearly understood that this description is made only by way of example and not as a limitation of the scope of the invention.

What is claimed is:

1. In an automatic engine controller for monitoring and controlling the operation of an internal combustion engine including:

(a) start means for activating the start of the engine;
(b) shutdown means for activating the shutdown of the engine;
(c) cranking module means for activating and deactivating said start means and including a solid state oscillator circuit which cycles on and off during crank mode;
(d) an overcrank module means for responding to an overcrank condition and deactivating said start means when the engine does not start within a specified time and including a solid state circuitry;
(e) a supply battery having a first and a second terminal;
(f) a first switch;
(g) a second switch;
(h) a common electrical point;
(i) fault sensors connecting to the first terminal of said battery; and
(j) a fault response circuit means for activating said shutdown means in response to a fault condition and containing fault sensors; an improvement comprising:
(k) said fault response circuit means having a fault response relay and associated means for operating said fault response relay in response to a fault condition, said fault response relay having first fault response relay contacts which are open in response to a fault condition and second fault response relay contacts which are closed in response to a fault condition;
(l) said common electrical point connecting separately
(1) through said first switch to the second terminal of said battery and (2) through said second fault response relay contacts to the second terminal of said battery;
(m) said common electrical point connecting separately
(1) through said cranking module and through said overcrank module to the first terminal of said battery and (2) through said sensors and through said fault response relay to the first terminal of said battery; and
(n) said fault response relay connecting to a terminal of said battery through said second switch.

2. The automatic engine controller of claim 1 in which said first fault response relay contacts and said second fault response relay contacts are in a single pole double throw configuration of the relay.

3. The automatic engine controller of clam 1 in which said second fault response relay contacts are connected directly to said second terminal.

4. The automatic engine controller of claim 3 in where there is only one current path from from said overcrank module circuitry to said second terminal.

5. The automatic engine controller of claim 1 which additionally includes an engine run relay connecting on one side to said common electrical point through said first fault response relay contacts and the other side to said first battery terminal.

6. The automatic engine controller of claim 1 which additionally includes a sensor responsive relay in series with a corresponding sensor responsive relay latching contact which combination connects to said common electrical point.

7. The automatic engine controller of claim 1 in which said sensor responsive relay connects to a terminal of said battery through said second switch.

8. The automatic engin controller of claim 1 which additionally comprises a fault indicator means and associated fault indicator latching means, for indicating fault conditions.

9. The automatic engine controller of claim 1 which additionally comprises a startup circuit means for preventing the activation of said fault response relay for a specified time after the closure of said first switch.

10. The automatic engine controller of claim 1 in which said second battery terminal is ground.

11. In an automatic engine controller for monitoring and controlling the operation of an internal combustion engine including:

(a) a supply battery having a first and a second terminal;
(b) start means for activating the start of the engine;
(c) shutdown means for activating the shutdown of the engine;
(d) a cranking module means for activating and deactivating said start means and including an oscillator circuit which cycles on and off during crank mode and including a solid state circuit;
(e) an overcrank module means for indicating an overcrank condition and deactivating said start means when the engine does not start within a specified time and including a solid state circuit;
(f) a fault response circuit means for activating said shutdown means in response to a fault condition; and
(g) diodes; the improvement comprising:
(h) said shutdown means including a solid state circuit which connects to said first terminal and in standby mode is disconnected from said second terminal by relay contacts;
(i) said solid state circuits of said cranking module means and said overcrank module means connecting to said second terminal and in standby mode are disconnected from said first terminal by relay contacts; and
(j) said diodes connecting between the solid state circuit of said shutdown means and said solid state circuits of said cranking module means and said overcrank module means.

12. The automatic engine controller of claim 11 wherein said diodes have a reverse voltage breakdown rating of at least 800 volts.

13. The automatic engine controller of claim 11 in which said second battery terminal is ground.

14. In an automatic engine controller for monitoring and controlling the operation of an internal combustion engine including:

(a) a cranking module means including a solid state timing circuit which cycles on and off during crank mode;

(b) an overcrank module means including a solid state timing circuit; and (c) an oscillator start and reset circuit; the improvement comprising:

(d) said oscillator start and reset circuit having three diodes, each diode having a first type terminal and a second type terminal the first type terminal of each diode being directly connected to a common electrical point, the second type terminal of said first diode being connected to said cranking module means the second type terminal of said second diode being connected to said overcrank module means and, the second type terminal of said third diode being connected to a first voltage potential through a means for opening a circuit; and a resistor having a first end and a second end, the first end of said resistor being directly connected to the common electrical point and, the second end of said resistor directly connected to a second voltage potential; the relative voltage of the first voltage potential and the second voltage potential being such that, in a closed circuit, current flows through said third diode.

15. The automatic engine controller of claim 14 in which the first type terminals of said diodes are cathodes.

16. The automatic engine controller of claim 15 in which said means for opening a circuit comprises relay contacts.

17. The automatic engine controller of claim 16 in which the relay contacts of said means for opening a circuit are normally closed and are open during the normal running of the engine.

18. In an automatic engine controller for monitoring and controlling the operation of an internal combustion engine, said engine including a battery charger and having a standby mode, a run mode, and a crank mode, the crank mode having crank portions and rest portions, an improvement comprising the means for activating and deactivating the battery charger of the engine comprising:

(a) two terminals;

(b) means for making an electrical connection between said terminals comprising two sets of relay contacts, each set of relay contacts having a closed and an open state, said two sets of relay contacts being in parallel with each other;

(c) means for controlling said first relay contacts in which said first relay contacts are always open during the crank portion of the crank mode and generally closed during the standby mode; and (d) means for controlling said second relay contacts in which said second relay contacts are always open during the crank portion of the crank mode, and generally closed during the run mode.

19. The automatic engine control of claim 18 in which said first relay contacts are normally closed and said second relay contacts are normally open.

20. The automatic engine control of claim 18 which additionally includes means for closing either said first relay contacts or said second relay contacts except during the crank portion of the crank mode.

21. The automatic engine control of claim 18 which additionally includes:

(e) a third normally open relay contact which is complementary to said first relay contact;

(f) a second normally closed relay contact which is complementary to said second relay contact; and (g) means for activating the crank of the engine comprising the series combination of the third and fourth relay contacts.

* * * * *